United States Patent [19]

High et al.

[11] Patent Number: 4,509,862

[45] Date of Patent: Apr. 9, 1985

[54] FEED PROCESSING SYSTEM

[75] Inventors: Sam High, Lititz; Aquila D. Mast, Lancaster, both of Pa.

[73] Assignee: Feedmobile, Inc., Lititz, Pa.

[21] Appl. No.: 527,130

[22] Filed: Aug. 29, 1983

[51] Int. Cl.[3] ..... B01F 7/08; B02C 19/00

[52] U.S. Cl. ..... 366/158; 366/186; 366/292; 366/299; 366/603; 241/98; 241/101.7

[58] Field of Search ..... 366/79, 158, 83–86, 366/156, 186, 177, 131, 271, 279, 292, 266, 297–301, 318–320, 325, 603; 241/30, 98, 101 B, 101.7; 99/348, 467, 471, 477

[56] References Cited

U.S. PATENT DOCUMENTS 3,804,377 4/1974 Kugle et al. ..... 366/292 X 4,148,395 4/1979 Syracuse et al. ..... 206/414

4,382,404 5/1983 Hawley et al. ..... 366/297 X 4,432,499 2/1984 Henkensiefken et al. ..... 366/603 X

*Primary Examiner*—Timothy F. Simone

*Attorney, Agent, or Firm*—Lackenbach Siegel Marzullo Presta & Aronson

[57] ABSTRACT

An industrial and feed mixing system including a mixing tank being supplied in part by a hammermill. A pair of vertical augers rotatably mounted in the tank convey feed upwardly. A bottom horizontal auger includes inner and outer auger flights of opposite hand that move feed inwardly to the pair of vertical augers. A horizontal agitator agitates feed at its ends and moves feed inwardly toward the pair of vertical augers. A top horizontal auger has top flights of opposite hand that convey feed outwardly from the pair of vertical augers.

14 Claims, 6 Drawing Figures

FEED PROCESSING SYSTEM

BACKGROUND OF THE INVENTION

This invention relates generally to feed processing systems and more particularly to feed processing systems that grind, mix, and blend animal feed material.

Feed processing systems are often packaged either to be transported on the back of a truck or installed as a stationary unit. The systems are meant to be operated by one person. Feed materials of various types are fed into the system where first grinding either by a hammermill or by a roll-mill, is accomplished; second, a mixing of the materials occurs; and third, simultaneously, with the mixing operation, a liquid feed material is sprayed onto the ground materials and blended. Unground concentrates may also be added during the mixing and blending process. Finally, the thoroughly mixed feed is drawn off either directly for bagging or to storage bins by way of a pneumatic apparatus. Several different types of feed materials are mixed and blended in a feed processing systems in particular designated quantities that are recommended through scientific evaluation of nutrient needs for particular animals. Some typical materials are ear corn, grain, whole bales of various kinds of feed, molasses, vegetable oils, and concentrated additives.

It is to be particularly noted that in order for the domestic animals being fed the feed mixture to thrive, there must be a complete and thorough mixing of all the materials entering the processing system before the mixed feed is drawn off for bagging or storage. Even slight disproportions in the mixed feed drawn off results in some animals being overfed certain minerals, vitamins, proteins, carbohydrates, and so on and in other animals being underfed the same ingredients.

In addition, temperature is to be kept low in a feed processing system since chemical changes in the feed can occur if the system heats the ingredients to certain ranges.

To accomplish the task set forth above, mixers employ augers and agitators of various positions, configurations, and rotational speeds in order to achieve a complete system that accomplishes the mixing task with a maximum of thoroughness of mixing and blending and with minimum of power consumption and a minimum of temperature elevation.

A patent that teaches a mixing apparatus for fluid feed material is U.S. Pat. No. 3,129,927 issued to Mast Apr. 21, 1964. An apparatus including a mixing tank 10 with four movements is described therein, namely, first, a horizontal spiral conveyor 27; second, a pair of vertical spiral conveyors 44; third, a horizontal agitator 53, and fourth, a pair of upper rotating radial arms 52. Without going into a detailed discussion here, Patent '927 also describes blade configuration and direction and bars 59, on paddles. An important feature of such a feed processing system is the rotational speed of each of the four movements. Such speeds are not discussed in Patent '927. It is known in the art, however, that the following speeds applied to the following movements: the bottom horizontal spiral conveyor, or auger: 119 rpms (average of 110–130 rpms); vertical conveyors, or augers: 172 rpms; horizontal main agitator: 102 rpms (average of 90–110 rpms); upper, or leveling, paddles (in lieu of radial arms 52): 117 rpms. There can be a 5–10 rpm variance in these speeds depending on the types of feed being processed.

Certain configurations of the augers and agitators are known in the art other than those of Patent '927. One such set of configurations is as follows: the bottom auger has a 9 inch vane diameter with a 9 inch spacing between the blades with paddles at the center of the mixer; the vertical augers are all 9 inch flutings; the top, or leveling, array has 7 paddles from end wall to end wall; and the paddles of the main agitator has all the paddles parallel to the shaft.

Although prior art feed processing systems perform fairly well, nevertheless, more economical, faster mixing and blending operations are desirable and possible. Lower fuel consumption would result. An altered drive can reduce friction and bearings and gears.

Feed processing systems of the type being discussed here include a hammermill or a roll-mill as the situation requires. A typical hammermill is described in U.S. Pat. No. 4,037,799 granted to Urban, July 26, 1977.

Accordingly, it is an object of the present invention to provide an improved feed processing system that will improve the speed and economy of present feed processing systems.

It is a further object of the present invention to provide an improved feed processing system that includes more advantageous configurations of the bottom, horizontal aurger, the vertical auger, the top, leveling augers, and the main, horizontal agitators.

It is yet another object of the present invention to provide an improved feed processing system that includes more advantageous rotating speeds for the bottom, vertical, and leveling augers and the main agitator than prior art speeds.

It is another object of the present invention to provide a mixer for evenly disbursing and thoroughly mixing many materials normally used in the feeding of farm livestock and industrial products.

It is a further object of the present invention to provide a mixing system for mixing feed materials and liquids such as molasses and proteins that can be evenly disbursed and uniformly blended into the various materials being mixed.

The improved feed processing system in accordance with the present invention comprises a system for mixing and blending industrial and feed materials including a feed mixing tank having opposed upright inner and outer end walls and opposed side walls secured to opposed top and bottom walls; a pair of vertical augers rotatably mounted between the top and bottom walls at the center portion of the mixing tank for conveying the feed materials upwards in the mixing tank; a horizontal bottom auger rotatably mounted between the inner and outer end walls for conveying the feed materials towards the pair of vertical augers at the center portion of the mixing tank; a horizontal agitator rotatably mounted between the inner and outer walls axially aligned over and spaced from the bottom auger for agitating the feed materials at areas proximate to the inner and outer end walls and for conveying the feed materials towards the pair of vertical augers at the center portion of the mixing tank; a horizontal top auger rotatably mounted between the inner and outer end walls of the mixing tank and axially aligned over said agitator and spaced proximately below the top wall of the mixing tank for conveying the feed materials outwardly from the pair of vertical augers at the center portion of the tank towards the inner and outer walls of the tank; and a pair of drivers associated with the mixing tank for rotating the vertical augers, the bottom auger, the horizontal agitator, and the top auger.

Each of the pair of vertical augers has a lower flight of spiral vanes and an upper flight of spiral vanes, the diameter of the upper flight being slightly larger than the diameter of the lower flight. The diameter of each upper flight is preferably approximately 12 inches and the diamter of each lower flight is preferably approximately 9 inches.

The bottom auger includes bottom inner and outer flights of spiral vanes of opposite hand so that as they are rotated convey the feed materials from the inner and outer end walls to the pair of vertical augers at the center portion of the tank. The inner and outer flights of the bottom augers have a preferable diameter of 9 inches and have vane sections spaced at approximately 6 inch intervals.

The horizontal agitator includes a horizontal shaft having an agitating arm at each end of the shaft proximate to the inner end wall and the outer end wall of the tank and inner and outer single-section auger flights of opposite hand positioned on opposed inner and outer sides of the pair of vertical augers. The inner and outer auger flights are rotated to convey the feed materials towards the pair of vertical augers.

A horizontal top auger has a pair of top inner and outer flights of spiral vanes that extend from a position spaced from the inner and outer end walls to the pair of vertical augers. The top inner and outer flights are of opposite hand and are rotated to convey feed materials from the pair of top augers outwardly toward the inner and outer end walls of the tank.

The bottom auger rotates at a slightly slower speed than the palr of vertical augers. The bottom auger preferably rotates at an approximate speed of between 155–175 rpm. The pair of vertical augers preferably rotate at an approximate speed of 167 rpm. The horizontal agitator shaft rotates at an approximate speed of between 30–40 rpm. The speed of the top auger preferably rotates at an approximate speed of 36 rpm.

The purpose of the present invention is to achieve a high degree of efficiency of mixing industrial and feed materials. Efficiencies of the following magnitudes have been achieved through use of the present invention:

Protein

Number of samples = 7
Average of sample values = 13.3714
Standard deviation = 0.359232.
80% of sample values within 3.49253% of the average value.
67% of sample values lie between 13.0122 and 13.7307.

Copper

Number of samples = 7.
Average of sample values = 134.429
Standard deviation = 16.7318.
80% of sample values within 16.1806% of the average value.
67% of sample values lie between 117.697 and 151.16.

The present invention will be better understood and the main objects and important features, other than those enumerated above, will become apparent when consideration is given to the following details and description, which when taken in conjunction with the annexed drawings, describes, discloses, illustrates, and shows the preferred embodiments or modifications of the present invention and what is presently considered and believed to be the best mode of practice in the principles thereof. Other embodiments or modifications may be suggested to those having the benefit of the teachings herein and such other embodiments or modifications are intended to be reserved especially as they fall within the scope and spirit of the subjoined claims.

DESCRIPTION OF THE PREFERRED EMBODIMENTS

Figure 1:
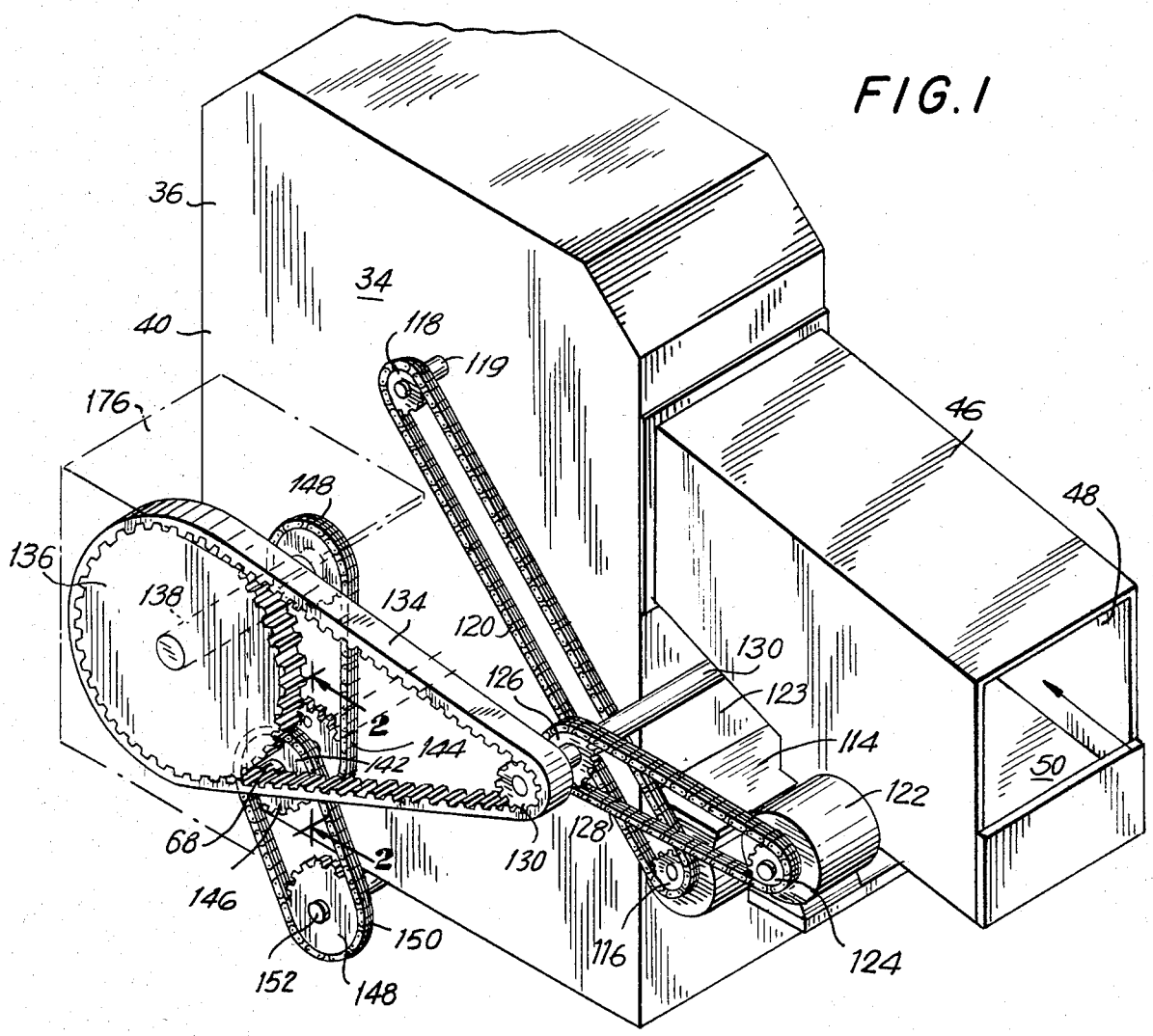
FIG. 1 is a perspective view of the drivers and primary belt drives and primary sprocket wheels and the housing of the hammermill incorporated in the feed processing system of the present invention.

Reference is now made to the drawings and in particular to FIGS. 1–6 in which identical or similar parts are designated by the same reference numerals throughout.

Figure 3:
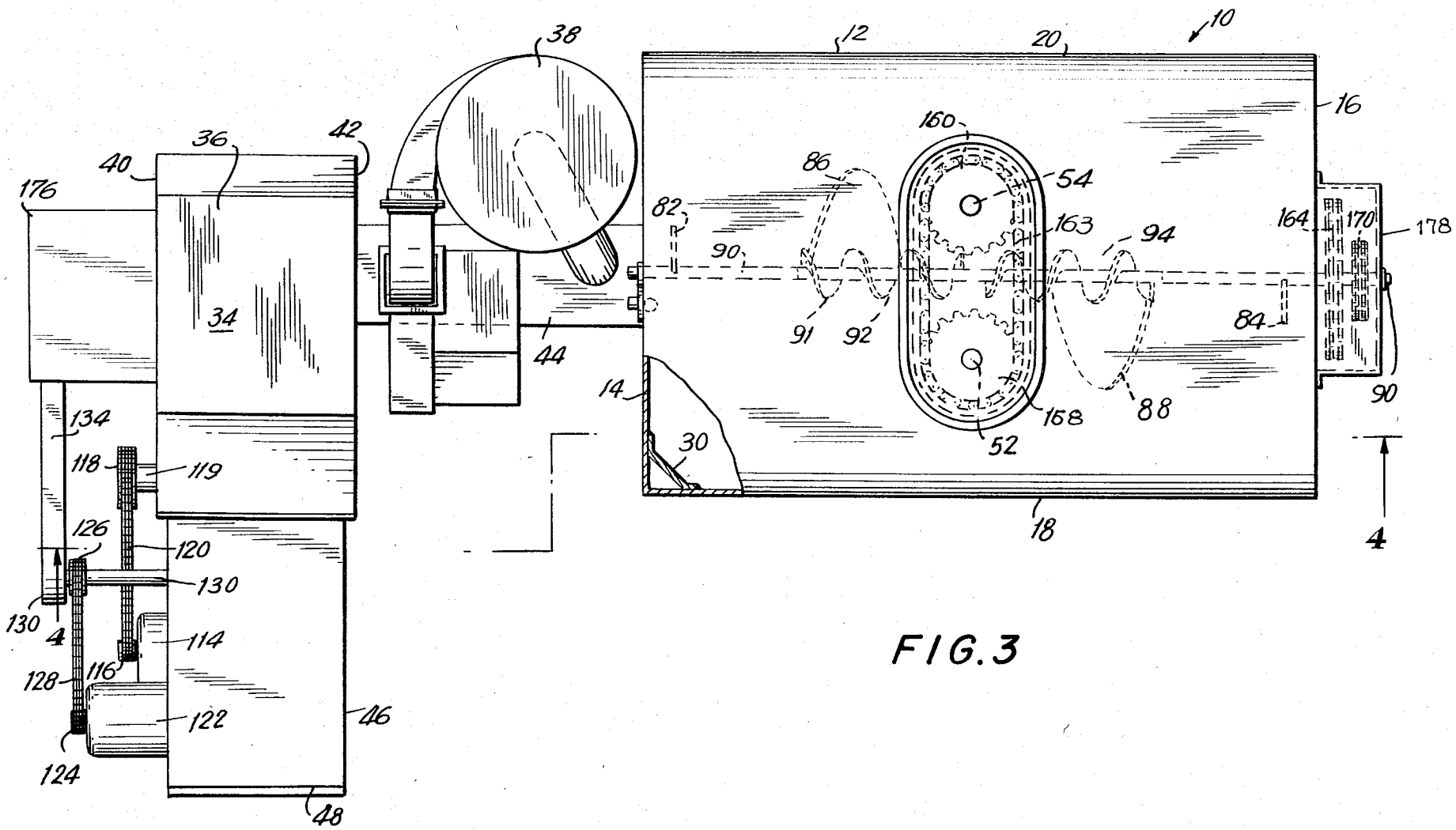
FIG. 3 is a top view of the feed processing system according to the present invention.
Figure 6:
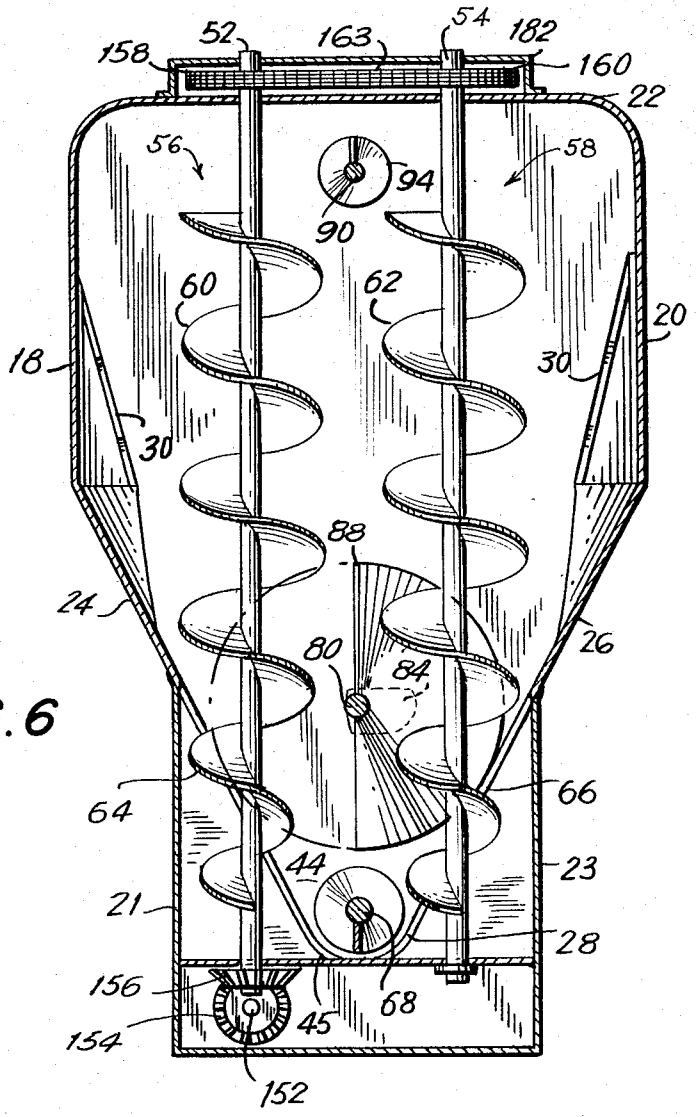
FIG. 6 is a section view taken through line 6—6 of FIG. 4.

Am improved feed processing system 10 is shown in a top view in FIG. 3. Feed processing system 10 according to the present invention includes an elongated mixer-blender container, or tank, 12 having opposed vertical inner and outer end walls 14 and 16 respectively and opposed upper vertical inner and outer side walls 18 and 20 respectively. As shown in FIGS. 5 and 6, upper vertical inner and outer side walls 18 and 20 extend vertically from a horizontal top wall 22 to sloping inner and outer side walls 24 and 26 respectively that slope inwardly towards one another at the same angle to opposed vertical inner and outer side walls 21 and 23 respectively. Vertical end walls 14 and 16 are connected to and contoured according to the inner and outer side walls 18, 20, 22, and 24, and in addition are connected to top and bottom walls 20 and 28. At each of the four corners of mixing tank 12 as seen in FIG. 3 and also in FIGS. 4 and 6, an inwardly slanting corner-piece 30 is connected to each side wall and each upper and lower wall from a position spaced below top wall 22 and a position spaced above bottom wall 28. The four corner-pieces 30 prevent feed material from becoming immobile in the corners of mixing tank 12 during the blending-mixing operation.

For purposes of describing the present invention, feed processing system 10 includes the mixing apparatus contained in tank 12 and the drive mechanisms that operate the mixing apparatus. Associated with feed processing 10 is a hammermill 34, which is not shown but is positioned in a hammermill housing 36 spaced from tank 12 as shown in FIG. 3 and a cyclone 38 positioned between hammermill housing 36 and tank 12. Hammermill housing 36 has opposed inner and outer walls 40 and 42, which are lateral to inner end wall 14 of tank 12 with inner wall 42 being spaced from inner end wall 14. As noted previously, hammermill 34 is generally similar to the hammermill described in U.S. Pat. No. 4,037,799.

FIG. 1 shows in a perspective view some of the driving mechanisms of feed processing system 10, which are mounted on along side outer wall 40 of hammermill housing 36. Extending between inner wall 42 of hammermill housing 36 and inner end wall 14 of tank 12 is an enclosed passageway 44, which is positioned below cyclone 38 into which it opens. Passageway 44 forms a bottom trough 45.

Extending transversely outwardly from hammermill housing 36 between inner and outer walls 40 and 42 is an enclosed passage 46 having a mouth 48 and a conveyor 46 extending along the bottom of passage 48 and leading to hammermill 34 within. Feed (not shown) of various types, including grains and roughages, are loaded onto conveyor 50 from where they are transported to hammermill 34 where it is ground. It is noted that although conveyor 50 is shown in the preferred embodiment, twin augers as described in Patent '799 may be employed in lieu of conveyor 50.

The ground feed is drawn in a manner to be described from hammermill 34 to mixer-blender tank 12 via passageway 44. The dust storm created in hammermill housing 36 is controlled by cyclone 38. A large fan (not shown) positioned immediately below cyclone 38 draws the dusty air up into cyclone 38. Baffles (not shown) over passageway 44 prevent feed from being sucked up into cyclone 38. In the cyclone, dust and air are separated; air goes out the top of the cyclone, and dust drops back into the feed in passageway 44.

At this point, an overall description of the mixing and blending mechanisms according to the present invention associated with tank 12 will be made before proceeding with a description of the driving mechanism.

Figure 4:
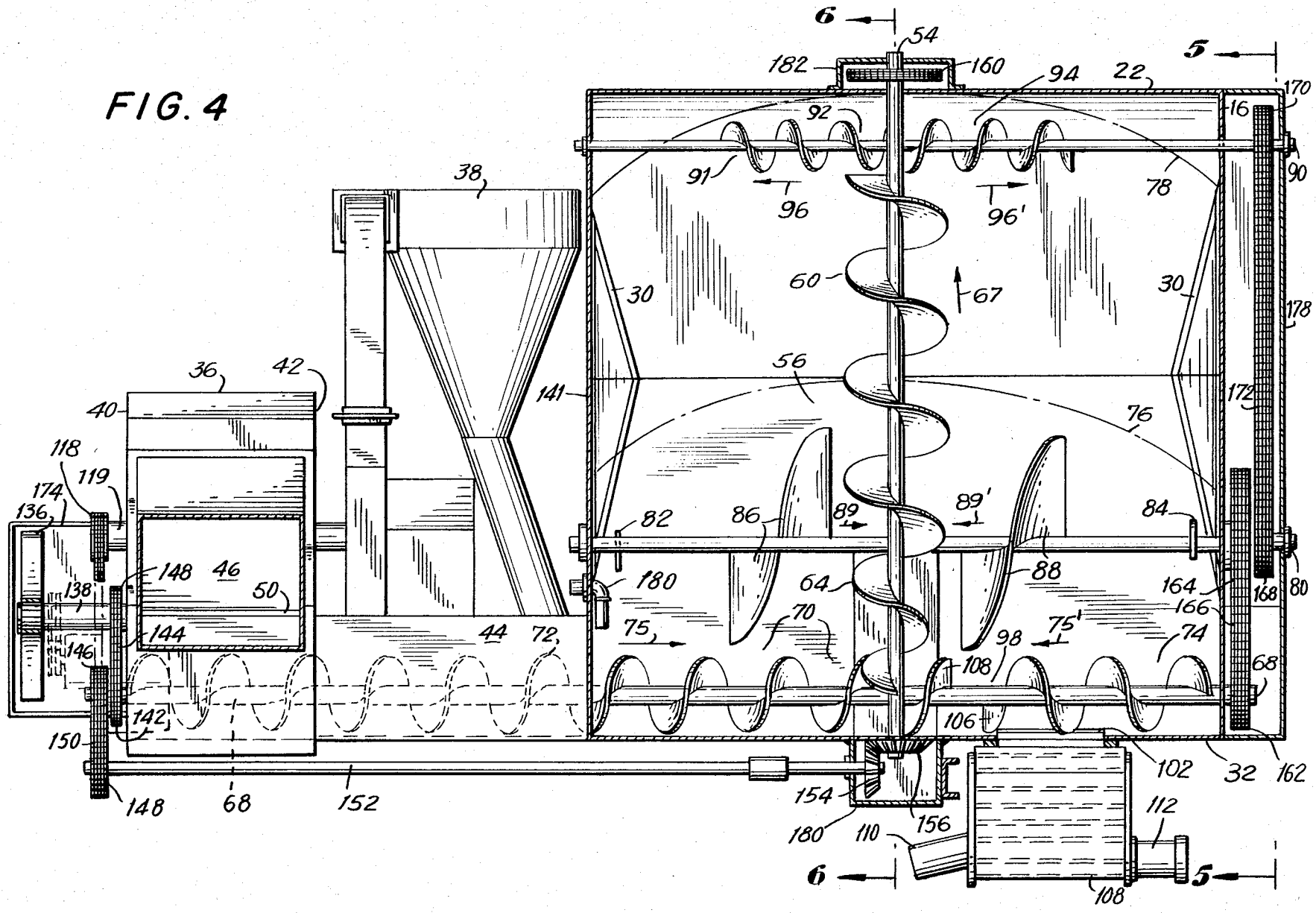
FIG. 4 is a side elevation view taken through line 4—4 of FIG. 3.
Figure 5:
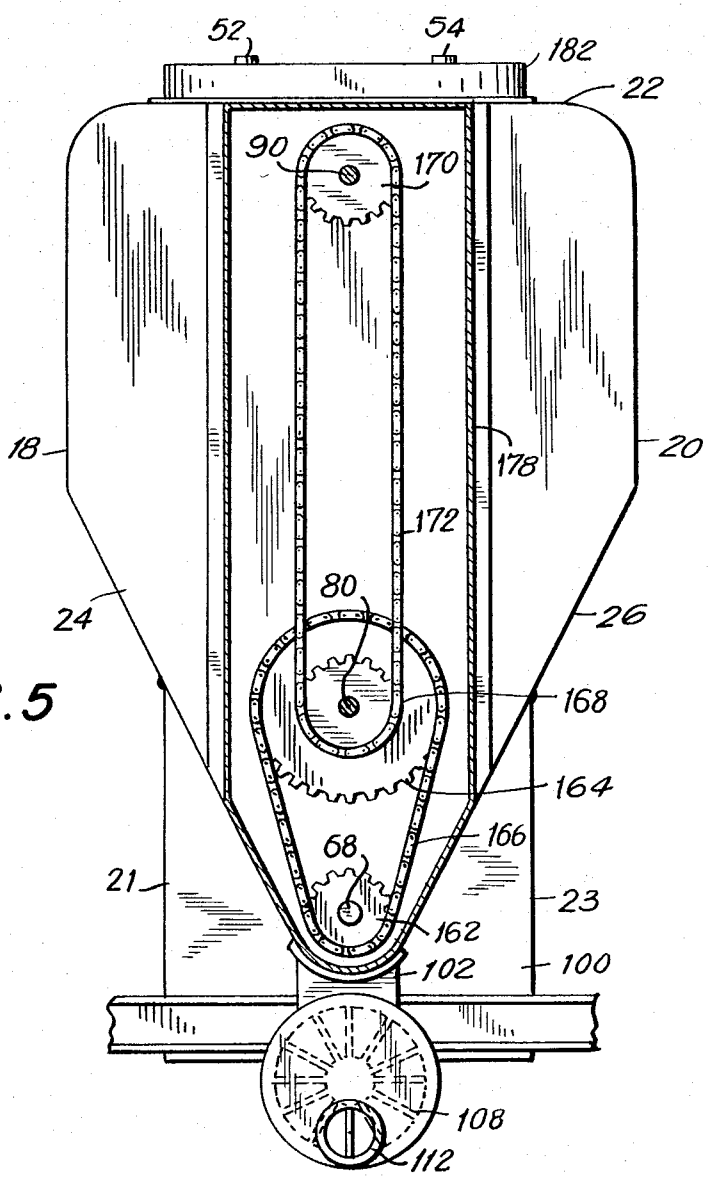
FIG. 5 is an end elevation view taken through line 5—5 of FIG. 4.

A pair of vertical shafts 52 and 54 are positioned in tank 12 as best seen in FIGS. 3, 4, and 6. Shafts 52 and 54 are positioned side by side each approximately parallel to and midway between end walls 14 and 16 and between top and bottom walls 22 and 32, at which walls shafts 52 and 54 are journaled in a suitable manner. Shaft 52 is spaced from inner side walls 18 and 24; and shaft 54 is spaced a similar distance from outer side walls 20 and 26. Shafts 52 and 54 are provided with flights of spiral vanes, or augers 56 and 58. Augers 56 and 58 are distributed into flights of upper augers 60 and 62 respectively and lower augers 64 and 66 respectively. Upper auger flights 60 and 62 extend between the upper portion of tank 12 to a position adjoining the lower portions of sloping side walls 24 and 26. The diameters of upper auger flights 60 and 62 are preferably larger than the diameters of lower auger flights 64 and 66. In the preferred embodiment, upper auger flights 60 and 62 are approximately 12 inches in diameter and lower auger flights 64 and 66 are approximately 9 inches in diameter. Augers 56 and 68 are of the same hand and are rotated by shafts 52 and 54 so as to move material vertically in the direction indicated by arrow 67 in FIG. 4.

A bottom, horizontal, elongated shaft 68 extends from outside wall 40 of hammermill housing 36 under hammermill 34, through lower passageway 44 under cyclone 38, through inner end wall 14 of tank 12, along and proximate to bottom wall 32, and to outer end wall 16. Shaft 68 in addition is positioned midway between inner and outer side walls 24 and 26 through 28. Shaft 68 is rotatably mounted on suitable journals outside of outer wall 40 of hammermill housing 36 and outside of outer end wall 16 of tank 12. Bottom shaft 68 is provided with horizontal bottom augers 70, which includes an inner auger flight 72 and an outer auger flight 74 of opposite hand to inner auger flight 72. Inner auger flight 72 extends between outer wall 40 of hammermill housing 36 and a position approximate to the plane of the axes of vertical shafts 52 and 54. Outer auger flight 74 extends between outer end wall 16 and a position proximate to but spaced from the plane of the axes of vertical shafts 52 and 54. Bottom shaft 68 is rotated in a direction that conveys feed in inner auger flight 72 in passageway 44 and in trough 45 towards vertical augers 56 and 58, that is, both inner and outer auger flights 72 and 74 each are rotated so as to force feed in their flights towards the center of tank 12 to vertical augers 56 and 58 as indicated by arrows 75 and 75' in FIG. 4. Horizontal bottom inner and outer auger flights 72 and 74 have sprial vanes approximately 9 inches in diameter and have vane sections spaced at 6 inch intervals.

At this point, a brief review of the movement of the feed in tank 12 will be made. Feed from hammermill 34 is directed via bottom inner auger flight 72 to vertical augers 56 and 58, which in turn raise the feed upwards in tank 12. When tank 12 is partially full, as indicated at a typical curved feed line 76 shown in phamtom line in FIG. 4, vertical augers 56 and 58 spread material radially outward over the top surface of the feed. This action occurs during charging, or filling, of tank 12 and discharging of tank 12. During times when tank 12 is full, vertical augers 56 and 58 lift feed towards the top portion of tank 12. A full level curved feed line 78 is shown in phantom lines at the top of mixing tank 12. As feed material is conveyed to maximum capacity line at inner roof 78, the feed comes into contact with a full level control member (now shown) that alerts suitable signaling devices to switch the infeeding mechanisms to prevent overfilling of tank 12. Suitable alternate feed exits (not shown) are provided at top wall 22 in the event signaling device become inoperative.

A horizontal middle shaft 80 extends between and is suitably journaled to end walls 14 and 16 of tank 12 in substantial vertical alignment with and spaced slightly above bottom horizontal shaft 68. Agitating arms 82 and 84 are located at opposite ends of middle shaft 80 spaced proximate from end walls 14 and 16. Arms 82 and 84 are mounted substantially perpendicular to the axis of middle shaft 80 at about 180 degree opposite orientation one to another. The rotation of arms 82 and 84 eliminates static areas at the ends of tank 12 and further provides a free flowing path, or channel, at each end for ground feed materials to reenter the end portions of inner and outer auger flights 72 and 74, that is, their ends proximate to tank end walls 14 and 16. It is noted here that inner auger flight 72 is slightly loaded as it moves ground feed from hammermill housing 36 to tank 12. At the point inner auger flight 72 enters tank 12, ground feed from the area above inside inner wall 14 fills inner auger flight 72 to maximum capacity capacity. Outer auger flight 74 at the opposite end is moving only feed coming from above in tank 12 in the area of agitating arms 82 and 84.

In accordance with the present invention, single inner and outer secitional auger flights 86 and 88 provided for middle shaft 80 are positioned on opposite inner and outer sides respectively of vertical shafts 52 and 54. Inner and outer sectional auger flights 86 and 88 are of opposite hand and convey feed materials toward vertical augers 52 and 54 as indicated by arrows 89 and 89' in FIG. 4. The side view shown in FIG. 6 illustrates that the diameters of sectioned flights 86 and 88 are such that their peripheries travel closely to the inner surfaces of vertical side walls 21 and 23. It is noted here that the two areas in which inner and outer sectional flights 86 and 88 are positioned have always been a problem in feed mixer apparatuses of the prior art in that the various feed materials conveyed into the mixer tank 12 during the charging cycle tend to shift into these two areas and remain there until mixer tank 12 is being discharged, with the result that the feed materials are mixed unevenly. Normally, the result of inner and outer sectional flights 86 and 88 conveying feed materials toward one another would result in frictional contact of the feed materials and concomitant high power consumption and heated feed materials. This problem is overcome by augers 56 and 58 which convey the feed materials upward into the free area above typical feed line 76.

A horizontal top shaft 90 extends between and is suitably journaled to end walls 14 and 16 of tank 12 in substantial vertical alignment with bottom shaft 68 and middle shaft 80. Top shaft 90 is spaced proximate to top wall 22. Top shaft 90 is provided with top augers 91, which comprise inner and outer top auger flights 92 and 94 of spiral vanes of opposite hands so that when top shaft 90 is rotated, flights 92 and 94 convey feed materials outwardly away from the center plane between end walls 14 and 16 as shown by arrows 96 and 96'. Inner and outer top auger flights 92 and 94 extend from positions spaced from inner and outer sub-walls 14 and 16 respectively to vertical augers 56 and 58.

Flights 92 and 94 terminate proximate to projected top feed line 78. After vertical augers 56 and 58 convey feed materials up to the top portion of tank 12, top auger flights 92 and 94 move the materials outwardly towards end walls 14 and 16. Top augers 91 are operative when tank 12 is charged almost to capacity when feed materials are conveyed outwardly towards side walls 14 and 16 from where the materials slide downwards to agitating arms 82 and 84 and to the end portions of bottom augers 70 as described previously. Top augers 91 in moving feed materials outwardly act to level feed line 78. It is noted here that prior art top augers known to the applicant are provided with paddles between the end walls rather than conveying augers.

In the practice of the invention, the diameter of the flighting for the top augers, which spread and level out the feed at the upper end of the mixer-blender tank 12 are preferably about 9 inches in diameter with a preferred separation of about 6 to about 9 inches. Such an arrangement has been found to be most efficient and effective in operation and such an auger construction is a significant improvement over the prior art paddle type of auger construction.

As noted earlier, inner and outer bottom auger flights 72 and 74 terminate at a short distance from one another. The space 98 formed between them as shown in FIG. 4 provides room for mixing tank 12 to accumulate its mixed feed materials prior to discharge. Finished mixed feed can be discharged from mixer tank 12 either by way of a bagger exit 100, shown in FIG. 5, or by way of a pneumatic rotary air lock unloader 102, shown in FIGS. 4 and 5. Bagger exit 100 is typically as shown in U.S. Pat. No. 3,129,927 granted to A. D. Mast Apr. 21, 1964 in column 3, lines 48–68. Inner ends 106 and 108 of auger flights 72 and 74 respectively act to disperse the feed and to clean out mixing tank 12 by way of either bagger exit 100 or unloader 102. Space 98 is approximately centered between bagger exit 100 or air lock unloader 102. The last finished feed leaving mixing tank 12 when unloading through bagger exit 100 is forced by inner end 108 of inner auger flight 72; and the last finished feed leaving mixing tank 12 when unloading through air lock unloader 102 is forced by inner end 106 of outer auger flight 74. The result is that the feed material is completely evacuated from space 98, whether bagger exit 100, air lock unloader 102, or a combination of the two are used. In pneumatic air lock unloader 102 the finished feed drops between the vanes of the rotating metering roll 108. As the vanes reach the bottom of roll 108, air from a pump (not shown) passed through inlet air take 110 out through outlet take 112 to storage.

The rotational speeds of the augers are related to the inventive aspects of the present invention described above. Inner and outer auger flights 72 and 74 rotate at a slower speed than vertical augers 56 and 58. In particular, bottom shaft 68 rotates between about 155 and about 175 rpm at an average rotational speed of about 167 rpm. The general maximum and minimum speeds are related to the type of feed material being mixed and to other irregularities. The vertical shafts 52 and 54 rotate at approximately 227 rpm. Middle shaft, or agitator, 80, rotate generally between about 30 and about 40 rpm at an approximate average speed of 36 rpm. Top, or leveling, augers 91 rotate at approximately 121 rpm. The rotational speeds given are subject to a 5–10 rpm variance, as are the rotational speeds of comparable augers and agitators as noted previously in the discussion of prior art.

Two drivers each connected to driving mechanisms are shown in FIG. 1. The first driver 114 shown is a suitable drive means, such as an electric motor mounted to the front of hammermill housing 36 by suitable means and drives hammermill 34 via motor sprocket wheel 116, hammermill sprocket wheel 118, and chain drive 120. Hammermill sprocket wheel 118 drives hammermill drive shaft 119. The second driver 122 may also be an electric motor mounted to hammermill housing 36 preferably to the front wall 123 of hammermill housing 36 under the passage housing 46 by suitable means. A motor sprocket wheel 124 drives a primary sprocket wheel 126 via chain 128. Primary sprocket wheel 126 is axially mounted to and provides rotational movement which provides rotational power to a short shaft 130 on its inner side to conveyor 50 and on its outer side to a small outer sprocket wheel 130. Rotational motion is transmitted via a belt drive 134 to a large sprocket wheel 13 axially connected to a short shaft 138 that in turn is axially connected to a firs medium-sized sprocket wheel 142 via chain belt 144. Second medium sprocket wheel 142 directly drives bottom shaft 68. Bottom shaft 68 also is connected at its inner end proximate to outer wall 40 of hammermill housing 36 to a third medium sprocket wheel 146 positioned beyond and proximate to second medium sprocket wheel 142. Third medium sprocket wheel 146 drives a fourth medium sprocket wheel 148 via a chain drive 150. Fourth medium sprocket wheel is set slightly towards the inner portion of mixing tank 12 and is axially connected to and rotates an elongated shaft 152, which extends horizontally parallel to proximately below, and slightly inward to bottom shaft 68 towards inner sloping side wall 24. Elongated shaft 152 extends to a vertical bevel gear 154 approximately midway along the side of mixing tank 12 to cooperative engagement with a horizontal bevel gear 156 which in turn is axially connected to the bottom end of vertical gear 52. Vertical bevel gear 154 rotates vertical gear 152 via horizontal bevel gear 156. As shown in FIG. 3, the top end of vertical shaft 52 is connected to a first top horizontal sprocket wheel 158 which drives a second top horizontal sprocket wheel 160 of equal size approximately on the same horizontal plane and axially connected to the top of vertical shaft 54 via a chain drive 163 so that vertical shaft 54 is rotated at the same rotational speed as vertical shaft 52.

Alternatively, in lieu of electric motors as the drive means, other suitable power sources, such as, diesel engines, gas engines, power-take-off drives, may be employed in the practice of the invention.

The far end of bottom shaft 68 outside of tank outer end wall 16 is axially connected to a first vertical end sprocket wheel 162 which drives a second vertical end sprocket wheel 164 of larger size as shown in FIGS. 4 and 5 that is positioned directly above on a vertical axial plane with first end sprocket wheel 162. Second end sprocket wheel 164 is driven by first end sprocket wheel 162 via drive chain 166. Second end sprocket wheel 164 is axially connected with and rotatably drives middle shaft 80. The outer end portion of middle shaft 80 is connected to and rotates a third vertical end sprocket wheel 168 positioned proximate to said end sprocket wheel 164, which is positioned between the outer surface of tank end wall 16 and third wheel 168. Third sprocket wheel 168 is smaller in diameter than vertical second end sprocket wheel 164 and slightly larger than first end sprocket wheel 162. A fourth vertical end sprocket wheel 170 is positioned directly above on a vertical axial plane with third sprocket wheel 168. Third and fourth sprocket wheels 168 and 170 are of equal diameter. Fourth end sprocket wheel 170 is rotatably driven by third sprocket wheel 168 via chain drive 172. Fourth sprocket wheel 170 is axially connected to and rotatably drives top shaft 90. The relative diameters of the sprocket wheels discussed above are proportional to the relative rotational speeds of the shafts they drive in accordance with the shaft speeds previously discussed.

The sprocket wheels and drive chains described are suitably enclosed within housings. In particular, sprocket wheels 136, 140, 142, 146 and 148, are enclosed within a housing 176 mounted to outer wall 40 of hammermill housing 36; and sprocket wheels 162, 164, 168 and 170 are enclosed with a housing 178 mounted to outer end wall 16 of mixing tank 12.

A bottom housing 180 affixed to bottom wall 28 encloses bevel gears 154 and 156. A top housing 182 connected to top wall 22 encloses sprocket wheels 158 and 160.

A portion of a spraying pipe 180 is shown in FIG. 4 with a liquid additive, usually molasses, being sprayed into the bottom portion of mixing tank 12 above inner auger flight 72. Unground concentrate can be introduced into mixing tank 12 near vertical augers 56 and 58 by means not shown.

Figure 2:
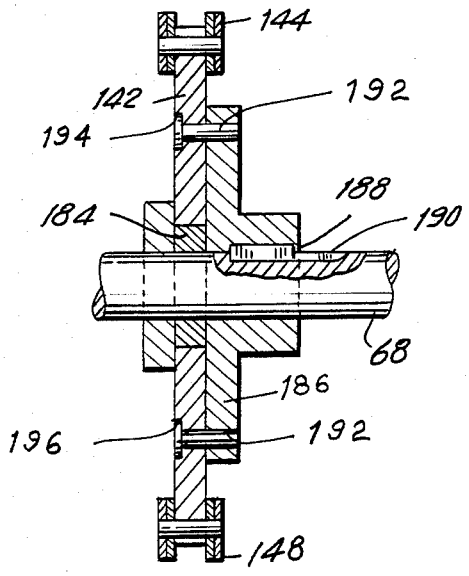
FIG. 2 is a detailed view of the drive shaft of the bottom, horizontal auger and of the shear pin assembly as taken through line 2—2 of FIG. 1.

In accordance with the present invention, and as shown in FIG. 2, main drive shaft 68 of bottom augers 70, which also drives middle agitator shaft 80 and top auger shaft 90, is driven by sprocket wheel 142 by chain drive 144. Bearings 184 are positioned around shaft 68. A drive mounting 186 is provided with a pin 188 that is positioned in shaft pin slot 190 in a known manner to provide rotational transmission to shaft 68. A plurality of sheer pins 192 positioned through pin recesses 194 and 196 in sprocket wheel 142 and drive mounting 186 are shearable if feed material in mixing tank 12 becomes jammed and prevents shaft 68 from rotating while motor 122 continues to run. Shear pins 192 upon shearing free sprocket wheel 142 to rotate freely and so allow motor 122 to continue to run without danger of burnout from overloading.

The embodiment of the invention particularly disclosed and described herein is presented merely as an example of the invention. Other embodiments, forms, and modifications of the invention coming within the proper scope and spirit of the appended claims will, of course, readily suggest themselves to those skilled in the art.

What is claimed is:

1. A system for mixing high moisture industrial and feed materials, in combination, comprising:

a feed mixing tank having opposed upright end walls and opposed side walls secured to opposed top and bottom walls;

vertical auger means rotatably mounted between said top and bottom walls at the center portion of said tank for conveying feed materials upwards in said tank;

horizontal bottom auger means rotatably mounted between said end walls conveying said feed materials towards said auger means at the center portion of said tank;

horizontal agitating and conveying means rotatably mounted between said end walls axially aligned over and spaced from said bottom auger means for agitating said feed materials at areas proximate to said end walls and for conveying said feed material towards said vertical auger means at the center portion of said tank;

horizontal top auger means rotatably means rotatably mounted between said end walls axially aligned over said agitating and conveying means and spaced proximately below said top wall for generally leveling said feed materials at the top portion of said tank and for conveying said feed materials outwardly from said vertical auger means at the center top portion of said tank;

exit means disposed at said bottom wall proximate to said vertical auger means for discharging said feed materials from said tank, and drive means associated with said tank for rotating said vertical auger means, said bottom auger means, said agitating and conveying means, and said top auger means, whereby said feed materials are mixed by a general movement of said feed materials from the bottom and middle portions of said end walls of said tank towards the bottom center portion of said tank, upwardly towards the top center portion of said tank, outwardly towards the top portion of said end walls of said tank, by gravitational movement to said bottom and middle portion of said tank, and then to said bottom portions of said tank and to said exit means.

2. A system according to claim 1, wherein said vertical auger means includes a pair of closely spaced vertical augers aligned transverse to said side walls of said tank.

3. A system according to claim 1, wherein each of said vertical augers has a lower flight of spiral vanes and an upper flight of spiral vanes, the diameter of said upper flight being slightly larger than the diameter of said lower flight.

4. A system according to claim 1, wherein the diameter of each said upper flight is approximately 12 inches and the diameter of each said lower flight is approximately 9 inches.

5. A system according to claim 4, wherein said bottom auger means includes a horizontal bottom auger having a first flight of spiral vanes that extends from one of said end walls of said tank to an end position proximate to said pair of vertical augers and a bottom second flight of spiral vanes that extends from the other of said end walls to a position proximate to said end position, said bottom first and second flights being of opposite hand, said bottom first and second flights being rotated by said drive means so as to convey said feed materials from said end walls to said pair of vertical augers.

6. A system according to claim 5, wherein said first and second flights have a diameter of approximately 9 inches and have vane sections spread at approximately 6 inch intervals.

7. A system according to claim 6, wherein said horizontal agitating means include a horizontal shaft having an agitating arm at each end of said shaft proximate to said one end wall and said other end wall and inner and outer single-section auger flights positioned on inner and outer sides respectively of said pair of vertical augers relative to said end walls, said inner and outer single-section auger flights being of opposite hand and being rotated by said drive means so as to convey said feed materials inwardly to said pair of vertical augers.

8. A system according to claim 7, wherein said top auger means includes a horizontal top auger having a top first flight of spiral vanes that extends from a position spaced from said one end wall of said tank to said paired vertical augers and having a top second flight of spiral vanes that extends from a position spaced from said other end wall of said tank to said pair of vertical augers, said top first and second flights being of opposite hand and being rotated by said drive means so as to convey said feed materials outwardly from said pair of vertical augers toward said end walls.

9. A system according to claim 8, wherein said bottom auger rotates at a slightly lower speed than said pair of vertical augers.

10. A system according to claim 9, wherein said bottom auger rotates at an approximate speed of between about 155 and about 175 rpm.

11. A system according to claim 10, wherein said pair of vertical augers rotate an an approximate speed of about 167 rpm.

12. A system according to claim 11, wherein said horizontal shaft rotates at an approximate speed of between about 30 and about 40 rpm.

13. A system according to claim 12, wherein said top auger rotates at an approximate speed of about 36 rpm.

14. A system according to claim 13, further including a main shaft rotated by said drive means, shaft and means connected to said main shaft for rotating said pair of vertical augers, said bottom auger, said horizontal shaft, and said top auger, said main shaft having means for separating said main shaft from said drive means if said feed materials prevent said main shaft from rotating.

* * * * *